United States Patent [19]

Wu

[11] Patent Number: 4,902,250

[45] **Date of Patent: * Feb. 20, 1990**

[54] ELECTRICAL PLUG AND SOCKET

[76] Inventor: Jeng-Shyong Wu, No. 133, Tungshing Road, Toufun, Maulii, Taiwan

[ * ] Notice: The portion of the term of this patent subsequent to Sep. 6, 2005 has been disclaimed.

[21] Appl. No.: 174,720

[22] Filed: Mar. 29, 1988

Related U.S. Application Data

[63] Continuation of Ser. No. 942,502, Dec. 16, 1986, Pat. No. 4,768,979, which is a continuation-in-part of Ser. No. 894,349, Aug. 7, 1986, Pat. No. 4,770,647, which is a continuation-in-part of Ser. No. 693,015, Jan. 18, 1985, abandoned.

[51] Int. Cl.[4] ..... H01R 13/68

[52] U.S. Cl. ..... 439/622; 337/197

[58] Field of Search ..... 337/197, 198, 201, 213; 439/621, 622

[56] References Cited

U.S. PATENT DOCUMENTS

| | | | |
|---|---|---|---|
| 2,257,608 | 9/1941 | Keefe | 337/197 |
| 2,462,934 | 3/1949 | Athey | 439/621 |
| 3,377,610 | 4/1968 | Busch et al. | 439/622 |
| 4,388,604 | 6/1983 | Ahroni | 337/197 |
| 4,420,214 | 12/1983 | Wu | 439/622 |
| 4,480,891 | 11/1984 | Wu | 439/622 |
| 4,684,914 | 8/1987 | Wu | 337/198 |

*Primary Examiner*—Gary F. Paumen

*Attorney, Agent, or Firm*—McGlew & Tuttle

[57] ABSTRACT

An electrical plug which has removable inner components and which may have on its rear end a pair of plug slots adapted to receive the prongs of a second plug. A fuse and a fuse conductor are removable from and insertable into a channel formed within the housing through respective openings in the housing wall. The conductor and its terminals are part of a conductor assembly which includes a resilient lip for a snap fit into the plug hosuing. The fuses are connected to a bracket or semi-bracket shape securing body that slides into the housing via a guide formed by the housing that connects with an upper arm of the bracket shaped securing body. The securing body fits tightly in the housing and provides a holding means for the connection between the conductor terminals, the fuses, and the prongs.

18 Claims, 6 Drawing Sheets

ELECTRICAL PLUG AND SOCKET

FIELD AND BACKGROUND OF THE INVENTION

This is a continuation application of Ser. No. 942,502 that was filed on Dec. 16, 1986. U.S. applicaton Ser, No. 942,502, matured into U.S. Pat. No. 4,768,979 on Sept. 6, 1988. Ser. No. 942,502 is a continuation-in-part of U.S. application Ser. No. 894,349. application Ser. No. 894,349, filed Aug. 7, 1986, matured into U.S. Pat. No. 4,770,647 of Sept. 13, 1988. application Ser. No. 894,349 was a continuation-in-part of application Ser. No. 693,015, filed Jan. 18, 1985, and which is now abandoned.

This application relates to an electrical plug construction including a pair of metallic prongs which are projected from a front end while at a rear end there may or may not be a pair of add-on plug slots or sockets which are adapted to receive the prongs of a second plug. Also, the electrical plug may optionally be split up into two halves.

SUMMARY OF THE INVENTION

It is an object of the invention to provide an electrical plug including an insulating housing having a channel, and a pair of conductors extending into the channel having a terminal fixed to the end of the channel. A seat of insulating material is provided in the channel, between the terminals, so that as to position and fix the terminals relative to the channel. A pair of prongs extends into the insulating housing. These prongs have at least a portion communicating with the channel. A securing body of insulating material is disposed within the channel and positioned between respective ones of the pair of prongs and the terminals, the securing body being removable from the housing. A pair of fuse elements are preferably disposed in the channel electrically connected between each set of one prong and one terminal, the securing body engaging a portion of each of the fuse elements so as to fix each of the fuses on the housing.

A further object of the invention is to provide an electrical plug and socket construction which is simple in design, rugged in construction and economical to manufacture.

Accordingly, it is the object of the invention to provide and improved electrical plug construction.

The various features of novelty which characterize the invention are pointed out with particularity in the claims annexed to and forming part of this disclosure. For a better understanding of the invention, its operating advantages and specific objects obtained by its uses, reference is made to the accompanying drawings and descriptive matters in which a preferred embodiment of the invention are illustrated.

DETAILED DESCRIPTION OF EMBODIMENTS

Figure 1A:
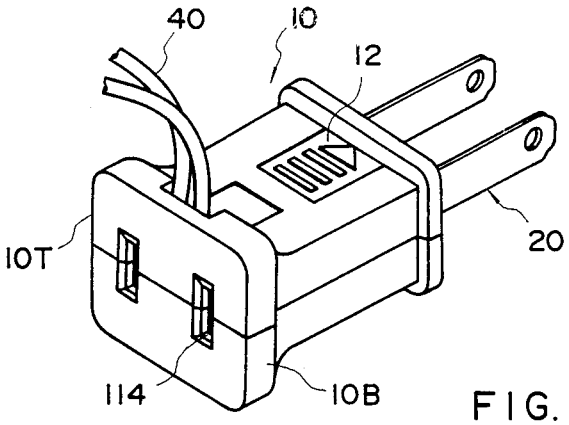
FIG. 1*a* is a prospective view showing an embodiment of an improved electrical plug according to the invention.
Figure 1B:
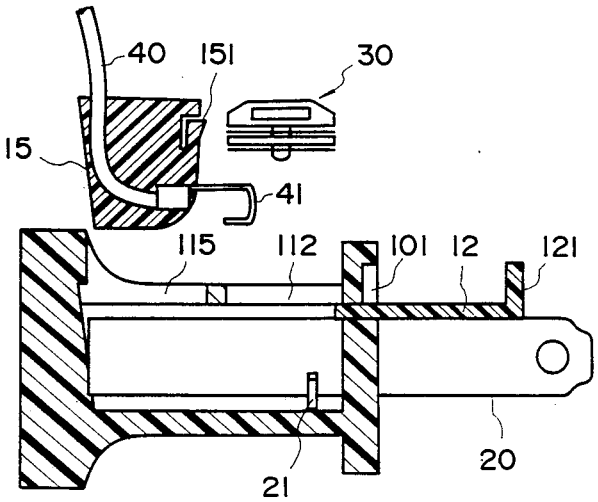
FIG. 1*b* is an exploded view of the electrical plug shown in FIG. 1*a;*
Figure 1C:
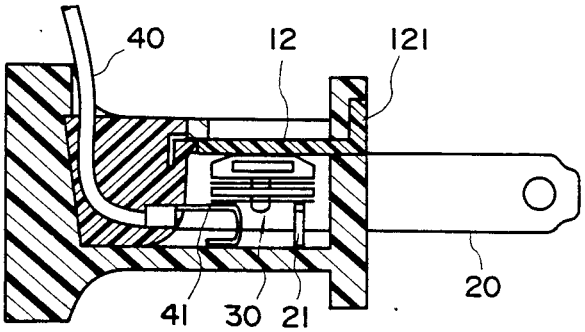
FIG. 1*c* is a sectional view showing the conductor assembly and securing body assembled.
Figure 2A:
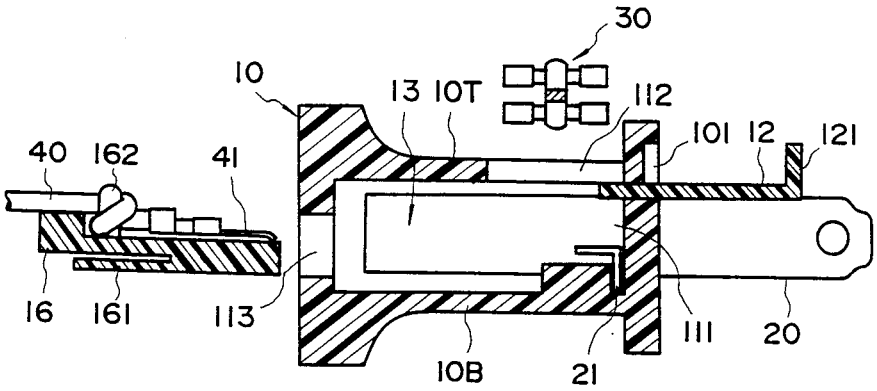
FIG. 2*a* is an exploded view showing a securing body which may be removed from the top side and a conductor assembly which may be removed from the rear portion of the housing.
Figure 2B:
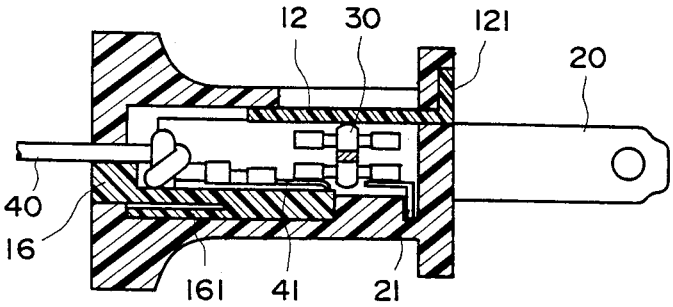
FIG. 2*b* is a sectional view showing the embodiment of FIG. 2*a* in its assembled state.

Referring to FIGS. 1 and 2, the electrical plug of the present invention includes a housing 10 of insulating material split into top and bottom halves 10T and 10B (FIG. 1) having a front opening, a top wall opening 112 and a rear opening 113 (FIG. 2). At the rear end, instead of an opening 113, there may be a pair of socket slots 114 (FIG. 1) serving as receptacles to a second plug. A pair of metallic prongs 20 each has a branch terminal 21. The branch terminal 21 effects mounting within the housing and also connects with fuses on one end of a securing body 30. The other end of the securing body is to contact with a terminal 41 of an incoming conductor 40 to constitute a part of the circuit. Through the top wall opening 112, the ready mounted securing body 30, carrying fuse elements, is to be inserted. The inserted securing body positions the fuses so as to be connected between conductor terminal 41 and prong branch 21 as aforementioned. The opening 112 is to be covered with a sliding door 12 with lock flange 121 which is to catch into a recess 101 provided in the corresponding position on the front end wall of the housing 10.

In the embodiment shown in FIG. 1, the conductor 40 is preplanted into a conductor assembly including a block 15 having a resilient lip 151 and inserted into the housing 10 through an opening 115 in top wall 10T. In the embodiment of FIG. 2 the conductor 40 is ready-mounted on a seat 16 by winding around an anchoring post 162. The seat 16 has a resilient lip 161 to be inserted into the rear end opening 113.

Figure 5A:
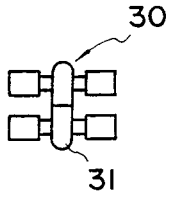
FIG. 5A shows still a further alternative embodiment of a ready-mounted fuse assembly.
Figure 5B:
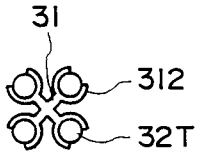
FIG. 5B shows still a further alternative embodiment of a ready-mounted fuse assembly.
Figure 4A:
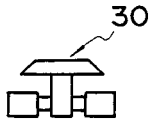
FIG. 4A shows an alternate embodiment of a ready-mounted fuse assembly.
Figure 4B:
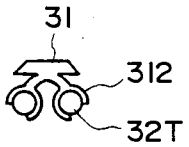
FIG. 4B shows another alternative embodiment of a ready-mounted fuse assembly.
Figure 3A:
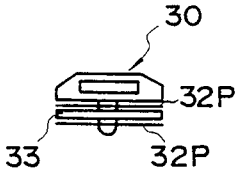
FIG. 3A shows a ready-mounted fuse assembly for use with the embodiment of FIG. 1*b;*
Figure 3B:
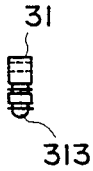
FIG. 3B shows a side view of an alternative embodiment of a ready-mounted fuse assembly.
Figure 3C:
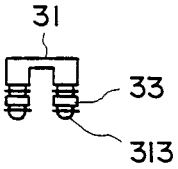
FIG. 3C shows a front elevation view of the ready mounted fuse assembly of FIG. 3B.

The securing body 30 related herein is further detailed in FIGS. 3A, 4A and 5A with alternative embodiments being shown in FIGS. 3B, 3C, 4B and 5B, respectively. Generally, the assembly 30, having a seat 31, constitutes either clamps 312 to hold a tubular type fuse cartridge 32T (FIGS. 4 and 5) or a projection 313 to take a plate type fuse strap 32P which is pre-attached onto each of both surfaces of an eyeleted plate 33. Each assembly may take from one to four fuse elements.

Figure 6A:
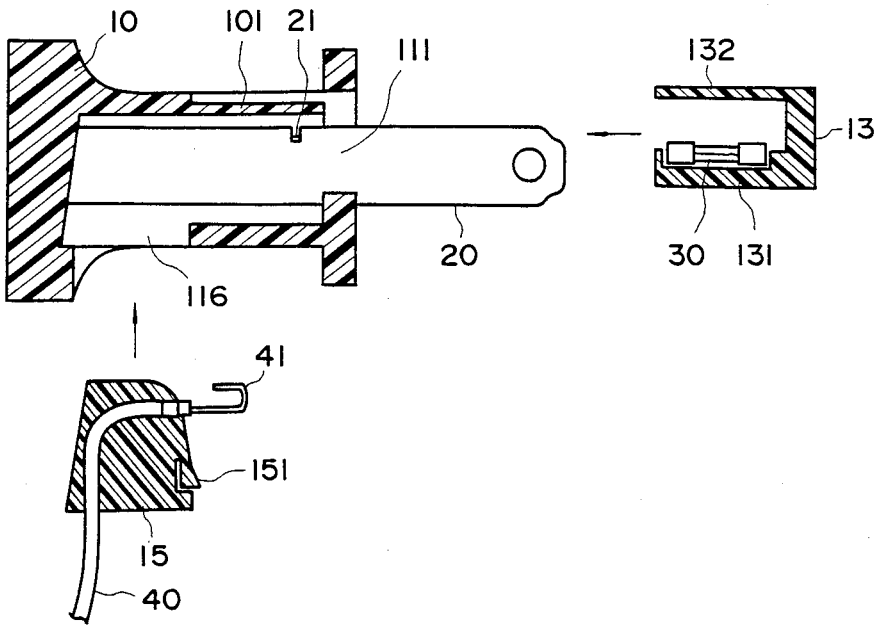
FIG. 6*a* shows and exploded view of an electrical plug assembly wherein the conductor assembly is mounted from the bottom of the plug assembly and the securing body is mounted through the front wall opening.
Figure 6B:
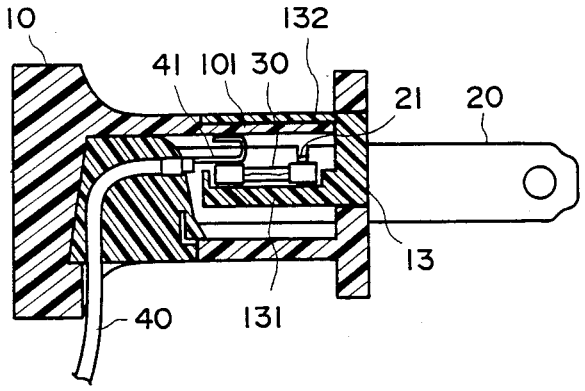
FIG. 6*b* is a sectional view showing the embodiment of FIG. 6*a* in an assembled form.

FIG. 6 shows a typical conversion of the insertion of the securing body 13 from the top side wall opening 112 into that of the front end opening type. The securing body 13, is formed as a semi-enclosed bracket with its bottom member 131 serving as a retainer for the fuse 30, (whatever the type may be), and the top member 132 of the bracket 13, serving as a sliding guide for the bracket 13. The top opening 112 is not employed in this embodiment, therefore, the top opening is sealed by a partition wall 101. In this embodiment, the conductor block 15 is inserted from a bottom side opening 116.

Figure 9:
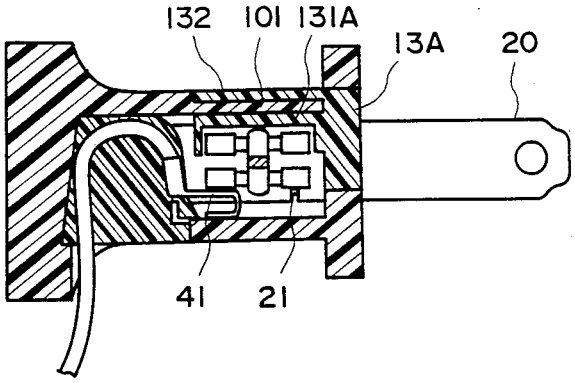
FIG. 9 is a sectional view showing still a further embodiment of the invention in which the conductor assembly may be admitted through a bottom portion of the housing and the securing body may be admitted through a front portion of the housing.
Figure 7:
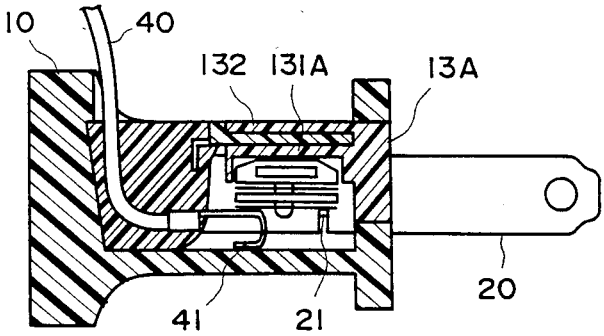
FIG. 7 shows still a further embodiment of the invention in which the securing body is inserted through the front wall opening and the conductor assembly is connected through an opening in the top of the housing.
Figure 8A:
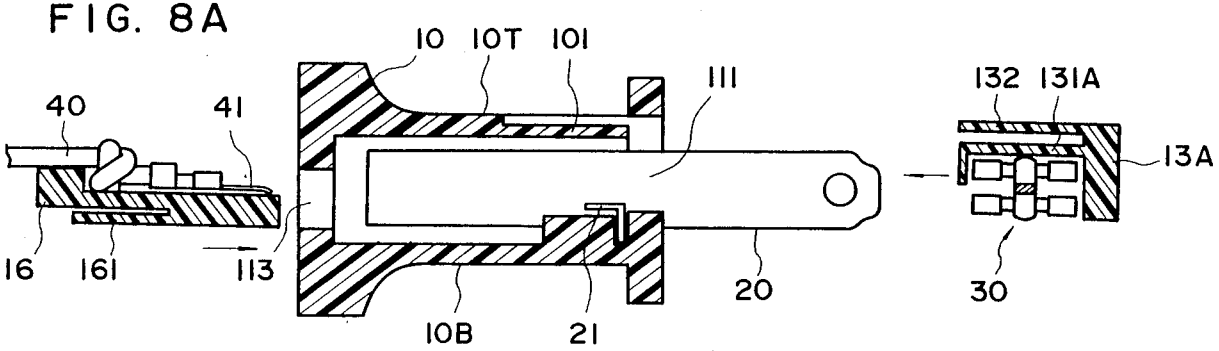
FIG. 8*a* is an exploded view of an electrical plug assembly in which the conductor assembly may be connected through a rear portion of the housing and the securing body may be connected through a front portion of the housing.
Figure 8B:
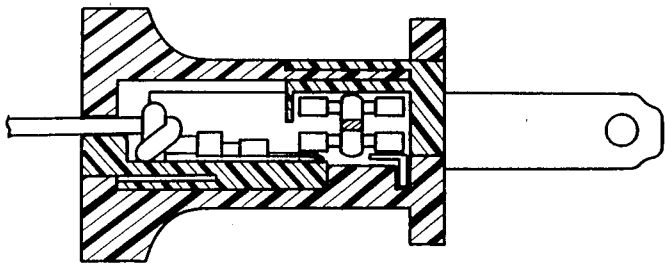
FIG. 8*b* is a sectional view showing the embodiment of FIG. 8*a* in assembled form.

In the embodiments shown in FIGS. 7, 8 and 9, a different type of insertion bracket 13A is used instead of bracket 13. In the new type of bracket 13A, the original retaining member 131 is moved upward adjacent to the top member 132 to become 131A, and incorporates said top member 132 as a guide along the partition wall 101. As for the conductor block of these three embodiments, FIGS. 7, 8 and 9, each is more or less similar to those in FIGS. 1, 2 and 6.

I claim:

1. An electrical plug comprising: an insulating housing defining a central channel, said housing having at least a first and second opening; first and second contact prongs, each of said contact prongs extending into said insulating housing and, a portion of each of said contact prongs communicating with said channel; a conductor assembly including a conductor body having a resilient lip portion, a first and second conductor mounted within the conductor body, and a first and second conductor terminal, said conductor assembly positionable within one of the openings in said housing, said resilient lip engaging a portion of said housing so as to retain the conductor assembly within said housing; and, a securing body insertable within said housing through the other of the openings through said housing, said securing body carrying a pair of fuse elements, the securing body being disposed within said housing so as to position one fuse element in electrical connection with the second prong and in electrical connection with the second conductor terminal.

2. A plug according to claim 1, wherein said openings are in the front end, the rear end, the top side wall, or the bottom side wall of the housing.

3. A plug according to claim 1, wherein said conductor assembly is admitted into the housing through an opening in the rear end thereof.

4. A plug according to claim 1, wherein said conductor assembly is admitted into the housing from one of a top or bottom side wall opening.

5. A plug according to claim 1, wherein the securing body is removable from and insertable into the front end of the housing.

6. A plug according to claim 1 wherein the securing body is in the form of a semi-enclosed bracket having a retaining member to seat said fuses.

7. A plug according to claim 6, wherein the securing body has guide members to slide along a partition wall disposed on a top wall opening of the housing.

8. A plug according to claim 1, wherein said housing includes a pair of through slots on the rear end thereof opposite to one of the prong ends for receiving prongs from another plug.

9. An electrical plug comprising: a housing made of insulating material; a channel inside said housing formed by a top wall, bottom wall, right side wall, left side wall, front wall and rear wall of said housing; a set of prongs extending outward from the front wall; a conductor assembly insertable into and removable from the housing; a securing body insertable into and removable from the housing; and a fuse element attachable to the securing body.

10. A plug according to claim 9 wherein:

said conductor assembly includes a conductor body to which a conductor is mounted, said conductor including a terminal for contact purposes, and said conductor body including a resilient lip thereon.

11. A plug according to claim 10, wherein:

said conductor assembly is removable from the housing by an opening in one of the top wall and bottom wall of the housing and being secured in the housing by means of the resilient lip contacting an inside edge of the housing.

12. A plug according to claim 10 wherein: said conductor assembly is removable or insertable through an opening in the rear wall of the housing and is secured in the housing by means of the resilient lip of said conductor body.

13. A plug according to claim 9 wherein the securing body is removed and inserted through the front end of the housing.

14. A plug according to claim 9 wherein: the securing body is in the form of a semi enclosed bracket on which the fuse is situated, said securing body fitting inside of the plug by means of mutual guide members formed by a top section of the securing body and an inside wall of the housing, said guide member of the securing body sliding on said guide member of the housing, said securing body, once inserted into the housing, providing a means for acquiring a connection between the conductor terminals, the fuse element and the prongs.

15. A plug according to claim 9 wherein: the conductor assembly and the fuse element and securing body are separately removable from the housing of the plug.

16. A plug according to claim 9, wherein said channel extends from an opening in said rear wall to an opening in said front wall providing free communication from said rear wall opening to said front wall opening.

17. A plug according to claim 16, wherein said conductor assembly includes a seat, said set of prongs being mountable on said seat.

18. An electrical plug comprising: A housing made of insulating material; an inner channel formed by a front wall, back wall, top wall, bottom wall, right side wall, and left side wall of the housing; prongs extending outward from the front wall of the housing; a conductor assembly including conductor wire and terminal mounted with a separate piece of insulating material, said piece of insulating material including a resilient lip, the conductor assembly being removable and insertable through one of a top wall, bottom wall, and rear wall of the housing; a fuse element removably connected to the terminals of the conductor and the prongs; a securing body in the form of a semi-enclosed bracket whereon the fuse element is situated, said securing body being removable and insertable through an opening in the front wall of the housing by means of a guide member in the housing contacting an upper edge of the securing body forming a sliding guide on which the securing body rides, said securing body serving the purpose of providing a tight contact within the channel of the housing between the terminal, the fuse element and the prongs.

* * * * *